United States Patent [19]

Walgrove

[11] Patent Number: 4,728,880

[45] Date of Patent: Mar. 1, 1988

[54] MULTIPLE VOLTAGE-PULSED CORONA CHARGING WITH A SINGLE POWER SUPPLY

[75] Inventor: George R. Walgrove, Rochester, N.Y.

[73] Assignee: Eastman Kodak Company, Rochester, N.Y.

[21] Appl. No.: 935,878

[22] Filed: Nov. 28, 1986

[51] Int. Cl.[4] ..... G05F 1/12

[52] U.S. Cl. ..... 323/267; 361/235; 307/32; 355/3 CH

[58] Field of Search ..... 323/267; 363/73; 361/229, 235; 307/31, 32; 250/324–326; 355/3 R, 3 CH, 14 CH

[56] References Cited

U.S. PATENT DOCUMENTS

| | | | |
|---|---|---|---|
| 2,991,360 | 7/1961 | Schneider et al. | 250/324 |
| 3,575,502 | 4/1971 | Eppe | 355/3 TR |
| 3,591,846 | 7/1971 | Schaffer | 307/31 |
| 4,159,428 | 6/1979 | Antonov et al. | 307/32 |
| 4,234,249 | 11/1980 | Weikel, Jr. et al. | 355/3 CH |
| 4,564,282 | 1/1986 | Shenoy | 355/3 CH |

*Primary Examiner*—Peter S. Wong
*Attorney, Agent, or Firm*—Milton S. Sales

[57] ABSTRACT

Apparatus is disclosed for driving from a single AC power supply a plurality of corona chargers and includes a substantially constant-potential power supply and a circuit interconnecting said power supply to the plurality of corona chargers such that a substantially constant average current input is delivered to each of the corona chargers. The circuit includes a capacitor associated with each corona charger between the power supply and the corona charger such that the capacitors charge upon transition of the AC power source, and thereupon discharge through the chargers until the corona onset potential is reached. Upon reaching the onset potential, the corona current is quenched. The capacitors are selected such that quenching occurs after the transition within a time interval less than half the period of the AC power supply so that each capacitor regulates the current output of the associated corona charger.

11 Claims, 4 Drawing Figures

MULTIPLE VOLTAGE-PULSED CORONA CHARGING WITH A SINGLE POWER SUPPLY

BACKGROUND OF THE INVENTION

1. Field of the Invention

This invention relates to improvements in corona charging devices.

2. Description of the Prior Art

In systems requiring a plurality of corona chargers, such as in electrostatographic copiers and/or printers, it is traditional to provide a power supply for each charger. A significant reduction in system cost could be realized if one power supply could be used to drive all the corona chargers.

Corona discharge is sensitive to atmospheric conditions of pressure and humidity because changes in atmospheric conditions alter the mobility of the charge carriers in air. If a corona wire is maintained at a constant potential, current from the corona wire will change with changing atmospheric conditions. Therefore, corona charger power supplies are by necessity constant average current supplies to compensate for the atmospheric condition sensitivity of the corona system.

However, constant current sources do not lead themselves to multiple-charger systems having only a single power supply because each charger would be sensitive to the operation of the other chargers. For example, if one charger wire were to break, a constant current power supply would increase its output potential to compensate for the drop in total supply current. This would cause excessive wire vibration, elevated current output, and possible arcing conditions in the other chargers.

SUMMARY OF THE INVENTION

It is an object of this invention to provide a system of multiple corona chargers which are operated from a single, constant-potential power supply and wherein atmospheric condition insensitivity is retained, allowing for stable operation under varying atmospheric conditions.

It is another object of this invention to provide a system of multiple corona chargers which are operated from a single AC constant-potential supply and wherein atmospheric condition sensitivity is effectively eliminated.

It is still another object of this invention to provide a system of multiple corona chargers which are operated from a single, square or trapezoidal wave, constant-potential power supply; and wherein atmospheric condition sensitivity is effectively eliminated.

It is yet another object of this invention to provide a system of multiple corona chargers which are operated from a single AC potential supply wherein both DC and AC charging can be obtained.

In accordance with the above objects, the present invention provides apparatus for driving a plurality of corona chargers from a single power supply. The apparatus includes a substantially constant-potential power supply and means electrically interconnecting said power supply to the plurality of corona chargers such that a substantially constant average current is delivered to each of the corona chargers. The power supply may be AC, and may have a square wave or a trapezoidal output.

In accordance with preferred embodiments of the present invention, at least one of the corona chargers receives an input with only an AC component and at least one of the corona chargers receives an input with a DC component. The interconnecting means including a capacitor associated with each corona charger between the power supply and the corona charger such that the capacitors charge upon transition of the AC power source and thereupon discharge through the chargers until the corona onset potential is reached. Upon reaching the onset potential, the corona current is quenched. The capacitors are selected such that quenching occurs after the transition within a time interval less than half the period of the AC power supply so that each capacitor regulates the current output of the associated corona charger. Variable resistors connect the corona chargers to ground such that adjustment of the impedance of the resistors changes the current outputs of the corona chargers. Alternatively, the capacitors may be variable, whereby the average currents for the corona chargers are adjustable.

It is an advantage of the present invention to significantly reduce the charger subsystem costs without compromising system performance by the utilization of one low cost power supply for a plurality of charging functions rather than using an individual power supply for each charger.

It is another advantage of the invention to provide the ability to program the charger output by selecting appropriately sized components, thereby permitting use of a common charger at plural locations which have completely different charger requirements.

It is yet another advantage of the present invention that both AC and DC charging is available from an AC power supply using only a few low cost, high voltage components.

It is still another advantage of the present invention that the system is insensitive to atmospheric conditions even though a constantpotential power source is used, thereby resulting in stable, reliable operation.

The invention and its advantages will become more apparent to those skilled in the art from the ensuing detailed description of preferred embodiments.

BRIEF DESCRIPTION OF THE DRAWINGS

The subsequent description of the preferred embodiments of the present invention refers to the attached drawings, wherein.

DESCRIPTION OF THE PREFERRED EMBODIMENTS

Figure 1:
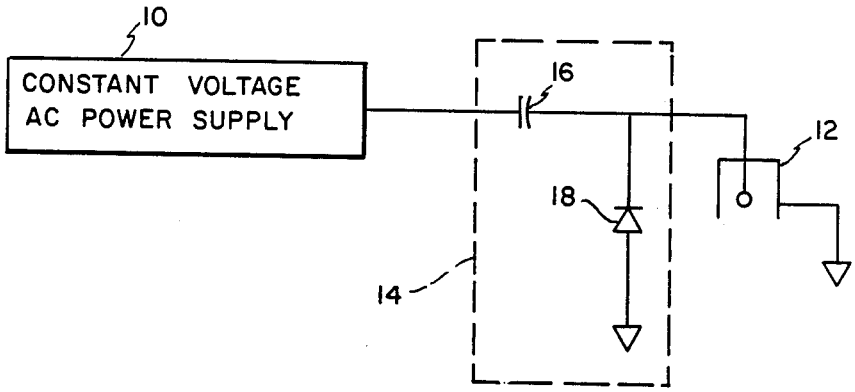
FIG. 1 is a diagram of a pulsed charging device in accordance with the present invention.

Referring to FIG. 1, a pulsed charging system includes an AC constant-potential power source 10, a corona charger 12, and a pulse circuit 14 between the power supply and the charger. Power supply 10 preferably has a trapezoidal or square wave output, and charger 12 is typically a single wire charger with a metal shell grounded or biased, depending on the output characteristics required.

Figure 2:
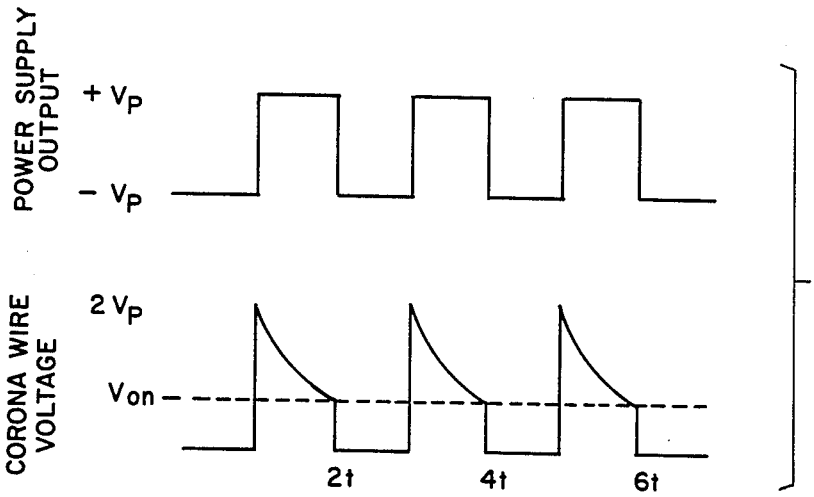
FIG. 2 is a graph of voltages at various positions in the device shown in FIG. 1.

Pulse circuit 14 includes a capacitor 16 and, for operation in a DC mode, a diode 18. Capacitor 16 regulates the average current output $I_{ave}$ of the charger device. FIG. 2, shows the output $V_p$ of power supply 10 and the wire potential at charger 12. The capacitor charges up when the AC power supply output transitions from a negative to a positive potential. The potential on the charger wire is driven to a level approximately twice that of the power supply potential. When corona onset occurs, and the wire begins to conduct, charge is drawn away from the capacitor. As the capacitor discharges, the wire potential drops until it reaches the wire onset potential $V_{on}$. At this point, the corona current is quenched, and the capacitor ceases to be discharged.

By proper selection of circuit components, the corona current will be quenched before the power supply steps negative again. That is, quenching will occur within less than a time interval t, where 2t is the period of power supply 10. The charge released is simply a function of the capacitor value and the wire voltage drop during charging. Since this process is repeated during each positive half cycle, the net result is a constant average current output $I_{ave}$ which can be determined by the following expression:

$$I_{ave}=[C(2V_p-V_{on}-v_{on}C_c]/2t.$$

where $C_c$ is the capacitance of charger 12.

This analytical analysis indicates that the pulsed charger will not exhibit significant environmental sensitivity. The corona onset potential $V_{on}$ is the only parameter sensitive to atmospheric changes, and this will not have a strong effect on the average current output $I_{ave}$. Therefore, atmospheric insensitivity is obtained even though a constant potential power supply is being used.

Figure 3:
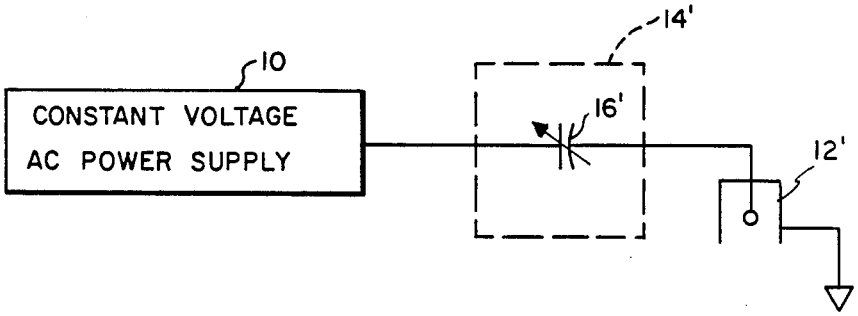
FIG. 3 is a diagram of a second embodiment of a pulsed charging device in accordance with the present invention.

FIG. 3 shows a pulsed AC charging configuration. It is essentially the same as the DC charging configuration of FIG. 1, with the elimination of diode 18 tap. Elements shown in FIG. 3 and common to the embodiment of FIG. 1 have been designated with the same reference numeral, but with a prime mark.

Figure 4:
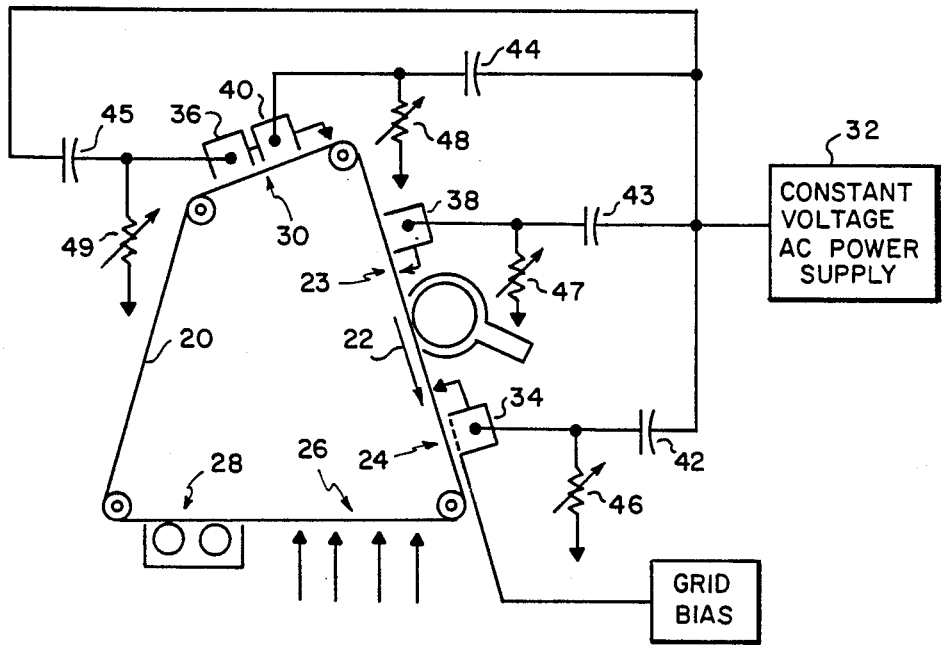
FIG. 4 is a schematic side elevational view of an electrographic machine in which the present invention is particularly useful.

A particularly useful application for the pulsed charger of the present invention is in electrostatographic copiers and/or printers. A xerographic copier, which is one form of electrostatographic machine, is shown in FIG. 4. An endless photoconductive belt 20 is supported on rollers for movement about a closed path in the direction of arrow 22. A plurality of image areas on belt 20 move past a cleaning station 23, a charging station 24, an exposure station 26, a development station 28, and a transfer station 30 to produce toned images on a receiver sheet, as is well known to those skilled in the art.

While conventional copiers employ four separate constant current power supplies, the illustrated copier incorporates a single 600 Hz. AC square wave power supply 32. A primary charger 34, a detack charger 40, and a preclean charger 38 are operated in the pulsed AC mode as shown in FIG. 3. A transfer charger 36 is run in the pulsed DC mode of FIG. 1. Good initial charge $V_0$ stability is required from primary charger 34, and is obtained by utilizing a grid on the primary charger. The grid is biased by either a passive device, such as a zener diode, or a DC power supply, both being well known technologies. Although not illustrated, it will be understood that primary charger 34 could be operated in a pulsed DC mode rather than the AC mode shown.

The values of capacitors 42–45, which drive each charger, are selected based on the charger output required and the nominal power supply potential expected. Individual charger current output adjustment is obtained by high voltage potentiometers 46–48 in the pulsed circuits. The potentiometers are used to vary the peak driving voltage by adjusting the impedance to ground. This shifts the voltage transition, and since the charger wire onset potential is fixed, the net result is an adjustment in the charger current output. A similar result could be accomplished without the potentiometers if the capacitors were adjustable, but this option would probably be more expensive.

From the above, it is apparent that the present invention results in a significant reduction of the charger subsystem costs without compromising system performance by the utilization of one low cost power supply for a plurality of charging functions rather than using an individual power supply for each charger. The invention provides the ability to program the charger output by selecting appropriately sized components, thereby permitting use of a common charger at plural locations which have completely different charger requirements. Both AC and DC charging is available from an AC power supply using only a few low cost, high voltage components. The system is insensitive to atmospheric conditions even though a constant potential power source is used, thereby resulting in stable, reliable operation. The invention has been described in detail with particular reference to preferred embodiments thereof, but it will be understood that variations and modifications can be effected within the spirit and scope of the invention.

I claim:

1. Apparatus for driving from a single power supply a plurality of corona chargers, said apparatus comprising:

a substantially constant-potential power supply; and means electrically interconnecting said power supply to the plurality of corona chargers such that a substantially constant average current is delivered to each of the corona chargers.

2. Apparatus for driving a plurality of corona chargers as defined in claim 1 wherein said constant-potential power supply is AC.

3. Apparatus for driving a plurality of corona chargers as defined in claim 1 wherein said constant-potential power supply is AC with a square wave output.

4. Apparatus for driving a plurality of corona chargers as defined in claim 1 wherein said constant-potential power supply is AC with a trapezoidal output.

5. Apparatus for driving from a single power supply a plurality of corona chargers, said apparatus comprising:

a substantially constant-potential power supply; and means electrically interconnecting said power supply to the plurality of corona chargers such that (1) a substantially constant average current is delivered to each of the corona chargers and (2) at least one of the corona chargers receives an input with only an AC component.

6. Apparatus for driving from a single power supply a plurality of corona chargers, said apparatus comprising:

a substantially constant-potential power supply; and means electrically interconnecting said power supply to the plurality of corona chargers such that (1) a substantially constant average current is delivered to each of the corona chargers and (2) at least one of the corona charges receives an input with a DC component.

7. Apparatus for driving from a single power supply a plurality of corona chargers, said apparatus comprising:

a substantially constant-potential power supply; and means electrically interconnecting said power supply to the plurality of corona chargers such that (1) a substantially constant average current is delivered to each of the corona chargers, (2) at least one of the corona chargers receives a DC input, and (3) at least one of the corona chargers receives an AC input.

8. Apparatus for driving from a single power supply a plurality of corona chargers having corona onset potentials, said apparatus comprising:

a substantially constant-potential AC power supply; and means electrically interconnecting said power supply to the plurality of corona chargers such that a substantially constant average current is delivered to each of the corona chargers, said interconnecting means including a capacitor associated with each corona charger between the power supply and its associated corona charger such that the capacitors charge upon transition of the AC power source and thereupon discharge through the chargers until the corona onset potential is reached, whereupon the corona current is quenched, said capacitors being selected such that quenching occurs after said transition within a time interval less than half the period of the AC power supply so that each capacitor regulates the current output of the associated corona charger.

9. Apparatus for driving a plurality of corona chargers as defined in claim 8 wherein said interconnecting means further comprises variable resistors connecting the corona chargers to ground such that adjustment of the impedance of the resistors changes the current outputs of the corona chargers.

10. Apparatus for driving a plurality of corona chargers as defined in claim 8 wherein said capacitors are variable, whereby the peak driving voltages for the corona chargers are adjustable.

11. Apparatus for driving from a single power supply a plurality of corona chargers, and apparatus comprising:

a substantially constant-potential AC power supply having half-cycles; and means electrically interconnecting said power supply to the plurality of corona chargers such that said AC power supply delivers current to said corona chargers during one of its half-cycles, and such that the half-cycle current delivered to each of the corona chargers is substantially constant.

* * * * *